US008573257B2

(12) United States Patent
Lin

(10) Patent No.: US 8,573,257 B2
(45) Date of Patent: Nov. 5, 2013

(54) OUTLET OF A SPIGOT

(76) Inventor: Chen-Chang Lin, Shengang Township, Taichung County (TW)

( * ) Notice: Subject to any disclaimer, the term of this patent is extended or adjusted under 35 U.S.C. 154(b) by 764 days.

(21) Appl. No.: 12/789,571

(22) Filed: May 28, 2010

(65) Prior Publication Data

US 2011/0289676 A1 Dec. 1, 2011

(51) Int. Cl.

| | |
|---|---|
| ***F16K 21/00*** | (2006.01) |
| ***E03B 1/00*** | (2006.01) |
| ***E03C 1/00*** | (2006.01) |
| ***B05B 1/00*** | (2006.01) |
| ***B05B 1/04*** | (2006.01) |
| ***F23D 14/48*** | (2006.01) |

(52) U.S. Cl.

USPC ..... 137/801; 137/603; D23/255; 239/589; 239/592

(58) Field of Classification Search

USPC ..... 137/801, 601.18, 599.03, 603; 4/675, 4/676, 677, 678; D23/238–240, 255; 239/17, 24, 25, 589, 590.5, 504, 592

See application file for complete search history.

(56) References Cited

U.S. PATENT DOCUMENTS

| | | | | |
|---|---|---|---|---|
| 6,286,808 | B1 * | 9/2001 | Slothower et al. | 251/118 |
| 8,251,094 | B2 * | 8/2012 | Lin | 137/601.18 |
| 8,316,887 | B2 * | 11/2012 | Lin | 137/601.18 |
| 2005/0023378 | A1 * | 2/2005 | Gregory et al. | 239/522 |
| 2007/0022529 | A1 * | 2/2007 | Thorne et al. | 4/678 |
| 2011/0272050 | A1 * | 11/2011 | Lin | 137/801 |
| 2012/0085446 | A1 * | 4/2012 | Lin | 137/801 |

* cited by examiner

*Primary Examiner* — Craig Schneider
*Assistant Examiner* — Michael R Reid
(74) *Attorney, Agent, or Firm* — Bacon & Thomas, PLLC

(57) ABSTRACT

An outlet of a spigot has a bottom seat, a neck, a head and a flow passage. The bottom seat has a bottom face. The neck is formed on and protrudes upward from the bottom seat. The head is formed on and protrudes forward from the neck and has a bottom side. The flow passage is formed in the outlet between the bottom seat, the neck and the head and has at least one inlet hole and an outlet hole. The inlet hole is formed through the bottom face of the bottom seat and communicates with the flow passage. The outlet hole is U-shaped, is formed in the head opposite to the neck and communicates with the flow passage.

1 Claim, 5 Drawing Sheets

OUTLET OF A SPIGOT

BACKGROUND OF THE INVENTION

1. Field of the Invention

The present invention relates to an outlet of a spigot, and more particularly to an outlet of a spigot that can provide a preferred cleaning effect.

2. Description of Related Art

A conventional spigot is mounted on a washbasin to spray water out from an outlet to allow a user to wash hands or objects.

The shape of the outlet of the conventional spigot may be circular or flat, so the water column sprayed out from the outlet is also circular or flat. However, the circular column or the flat water column cannot meet the requirement of washing a long object, such as hands and may decrease the washing efficiency. In addition, the water column may spray everywhere when the water pressure is increased and this wastes water.

The invention provides an outlet of a spigot that mitigates or obviates the aforementioned problems.

SUMMARY OF THE INVENTION

The main objective of the present invention is to provide an outlet of a spigot that can provide a preferred cleaning effect.

The outlet of a spigot in accordance with the present invention has a bottom seat, a neck, a head and a flow passage. The bottom seat has a bottom face. The neck is formed on and protrudes upward from the bottom seat. The head is formed on and protrudes forward from the neck and has a bottom side. The flow passage is formed in the outlet between the bottom seat, the neck and the head and has at least one inlet hole and an outlet hole. The inlet hole is formed through the bottom face of the bottom seat and communicates with the flow passage. The outlet hole is U-shaped, is formed in the head opposite to the neck and communicates with the flow passage.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
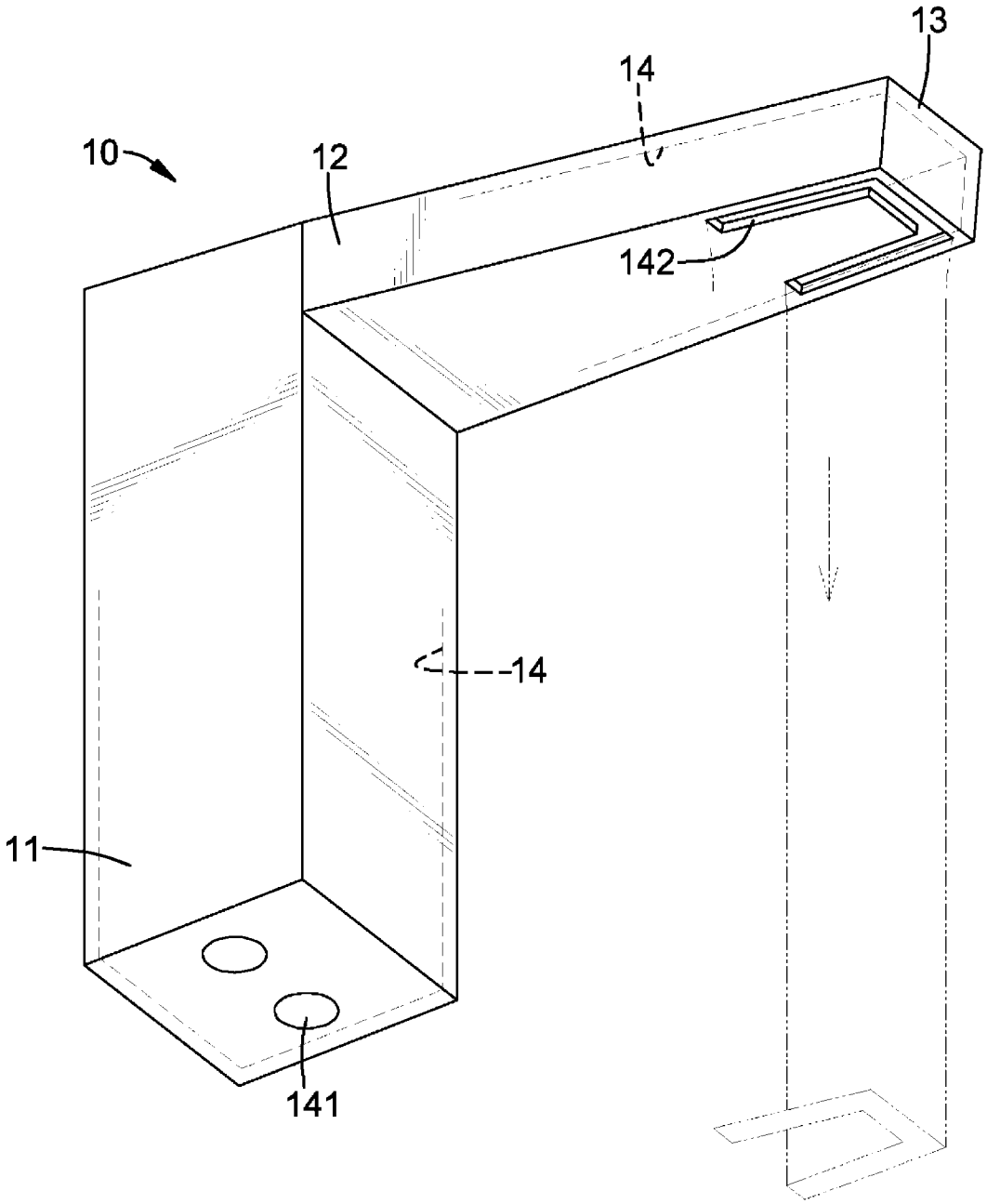
FIG. 1 is a perspective view of a first embodiment of an outlet of a spigot in accordance with the present invention.

With reference to FIG. 1, a first embodiment of an outlet 10 of a spigot in accordance with the present invention comprises a bottom, a bottom seat 11, a neck 12, a head 13 and a flow passage 14.

The bottom seat 11 may be quadrate, is formed on the bottom of the outlet 10 and has a flat bottom face. The neck 12 is formed on and protrudes upward from the bottom seat 11. The head 13 is formed on and protrudes forward from the neck 12 and has a bottom side. The flow passage 14 is formed in the outlet 10 between the bottom seat 11, the neck 12 and the head 13 and has at least one inlet hole 141 and an outlet hole 142. The inlet hole 141 is formed through the bottom face of the bottom seat 11 and communicates with the flow passage 14. The outlet hole 142 is U-shaped, is formed through the bottom side of the head 13 and communicates with the flow passage 14.

Figure 2:
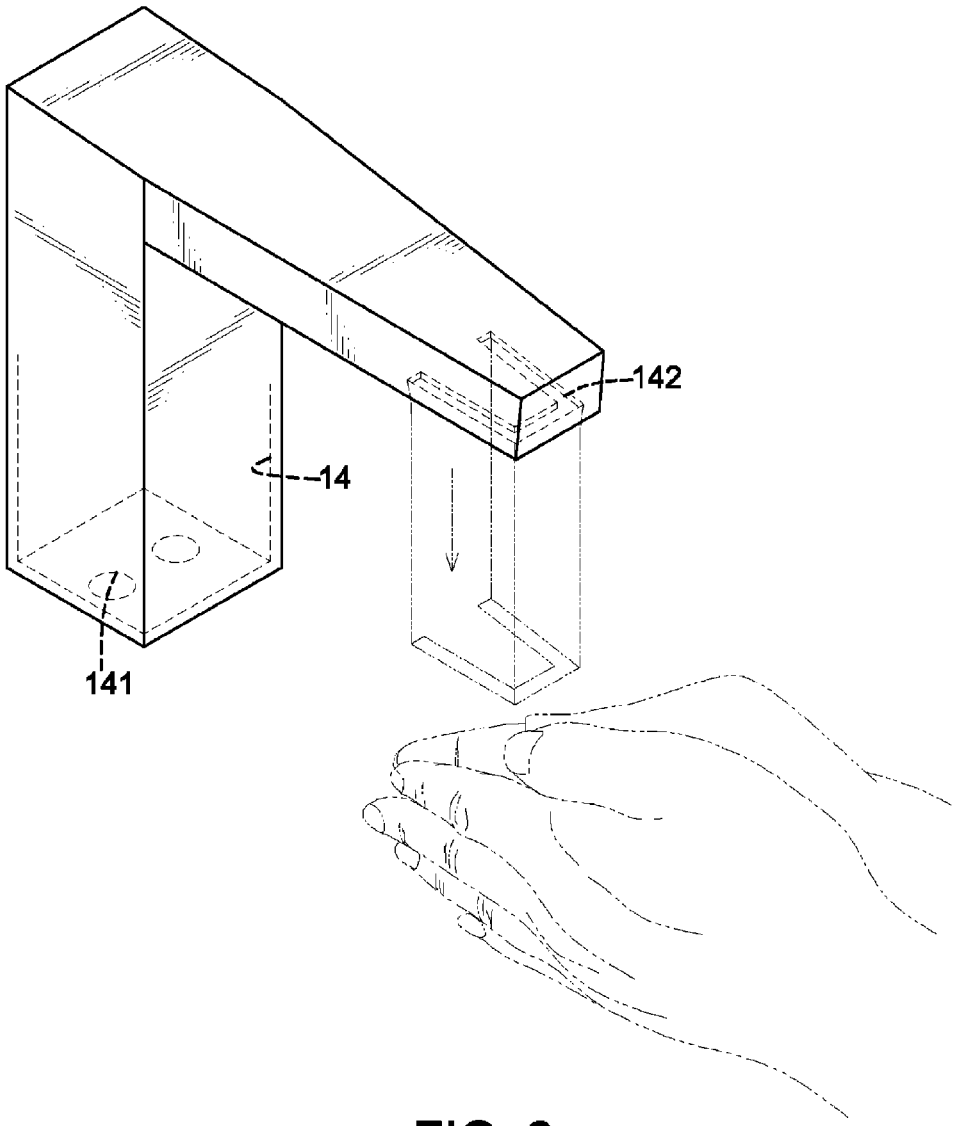
FIG. 2 is an operational perspective view of the outlet of a spigot in FIG. 1.

With reference to FIG. 2, when using the first embodiment of the outlet 10 of a spigot in accordance with the present invention to wash hands, water flows into the flow passage 14 via the inlet hole 141 and flows out of the outlet 10 from the outlet hole 142. The water column sprayed out from the outlet hole 142 has a corresponding shape as the outlet hole 142 has. Consequently, water can spray on the whole hands and provide an excellent washing effect. In the same volume of water, the outlet hole 142 of the outlet 10 in accordance with the present invention can provide a preferred washing effect than that provided by the conventional circular or flat outlet of the conventional spigot. Furthermore, when the water pressure is increased, the shape of the outlet hole 142 can prevent the water column from spraying everywhere and this can reduce the waste of water.

Figure 3:
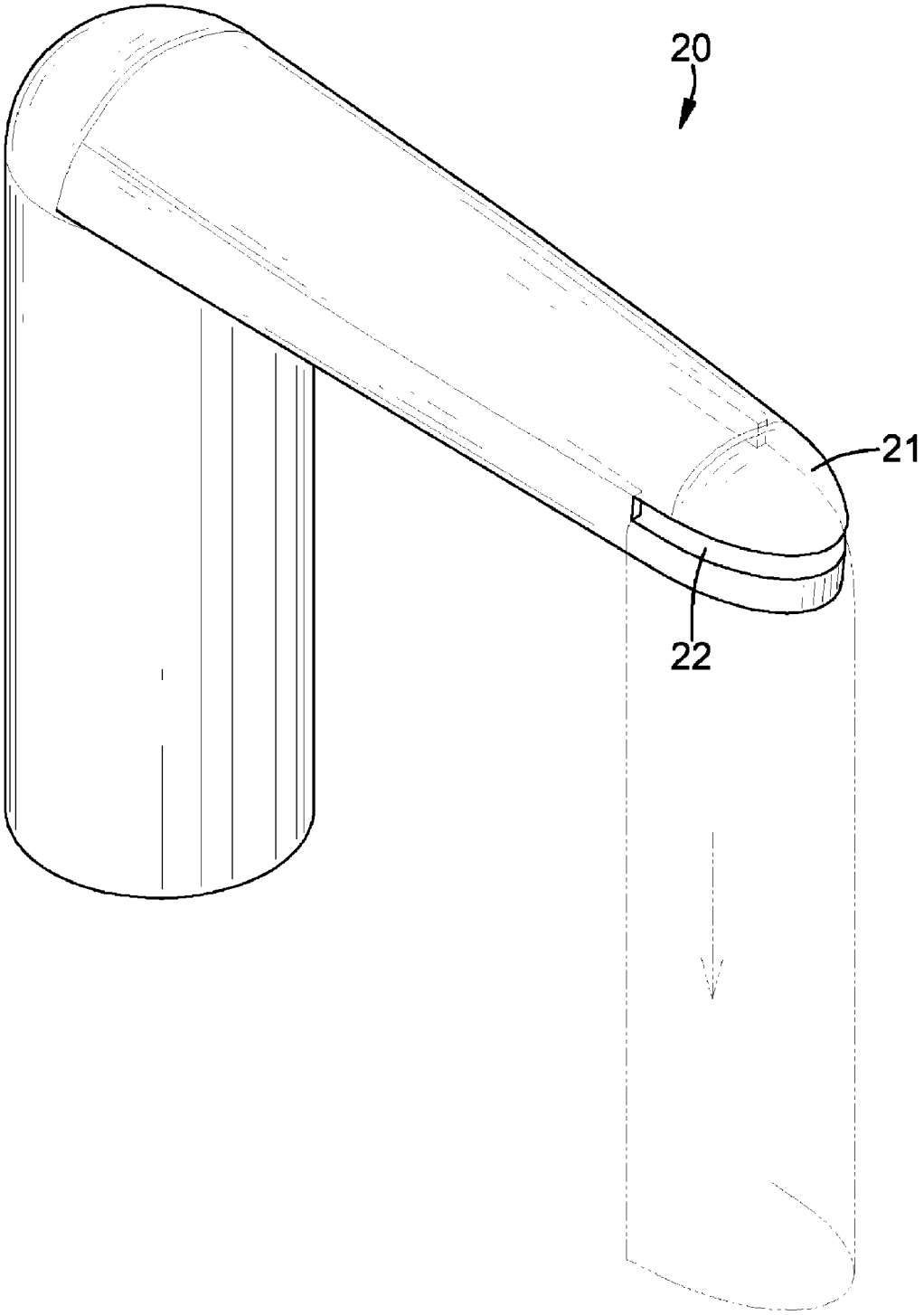
FIG. 3 is a perspective view of a second embodiment of an outlet of a spigot in accordance with the present invention.

With reference to FIG. 3, an outlet 20 of a spigot of a second embodiment in accordance with the present invention has a similar structure as the outlet 10 of a spigot of the first embodiment. The head 21 of the outlet 20 has a U-shaped sidewall and the outlet hole 22 is formed through the sidewall of the head 21. Then, water flows out of the outlet 20 from the outlet hole 22 to form a U-shaped water column.

Figure 4:
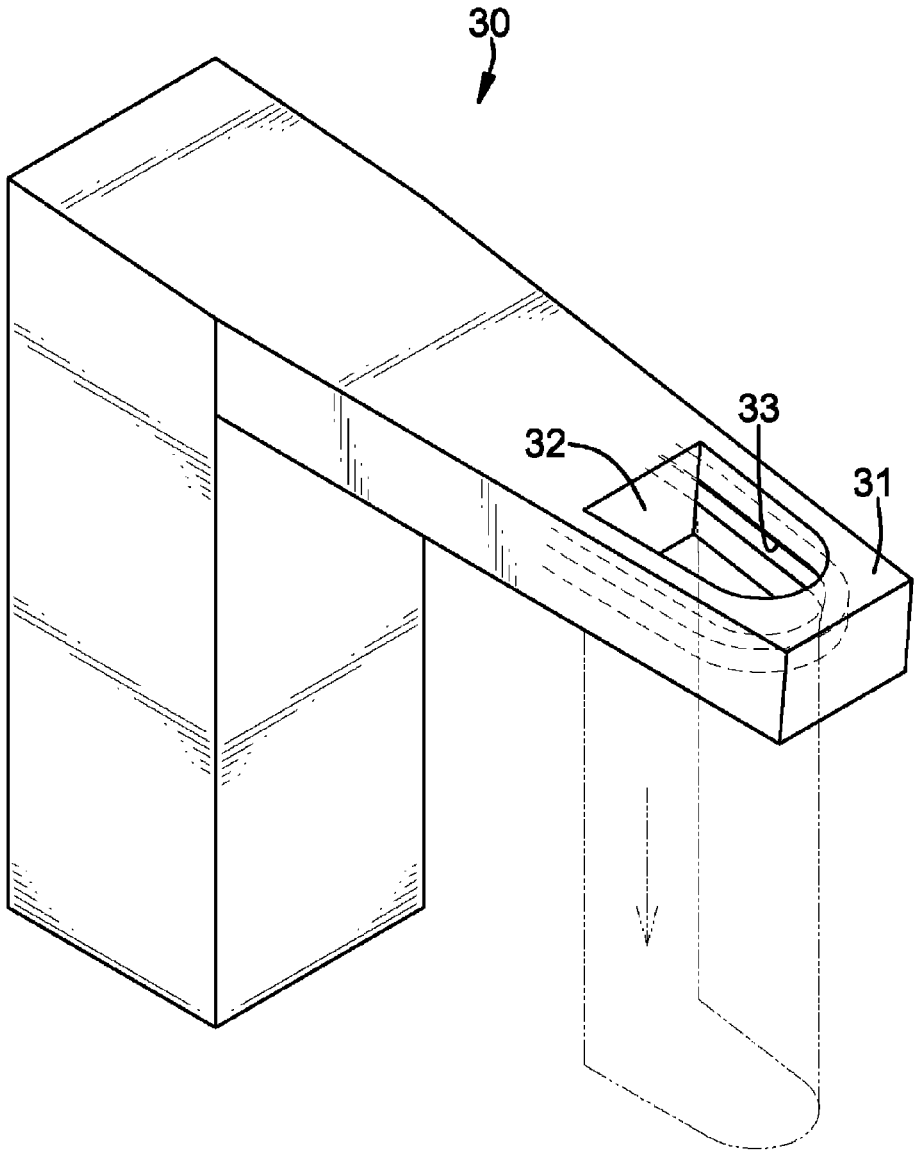
FIG. 4 is a perspective view of a third embodiment of an outlet of a spigot in accordance with the present invention.
Figure 5:
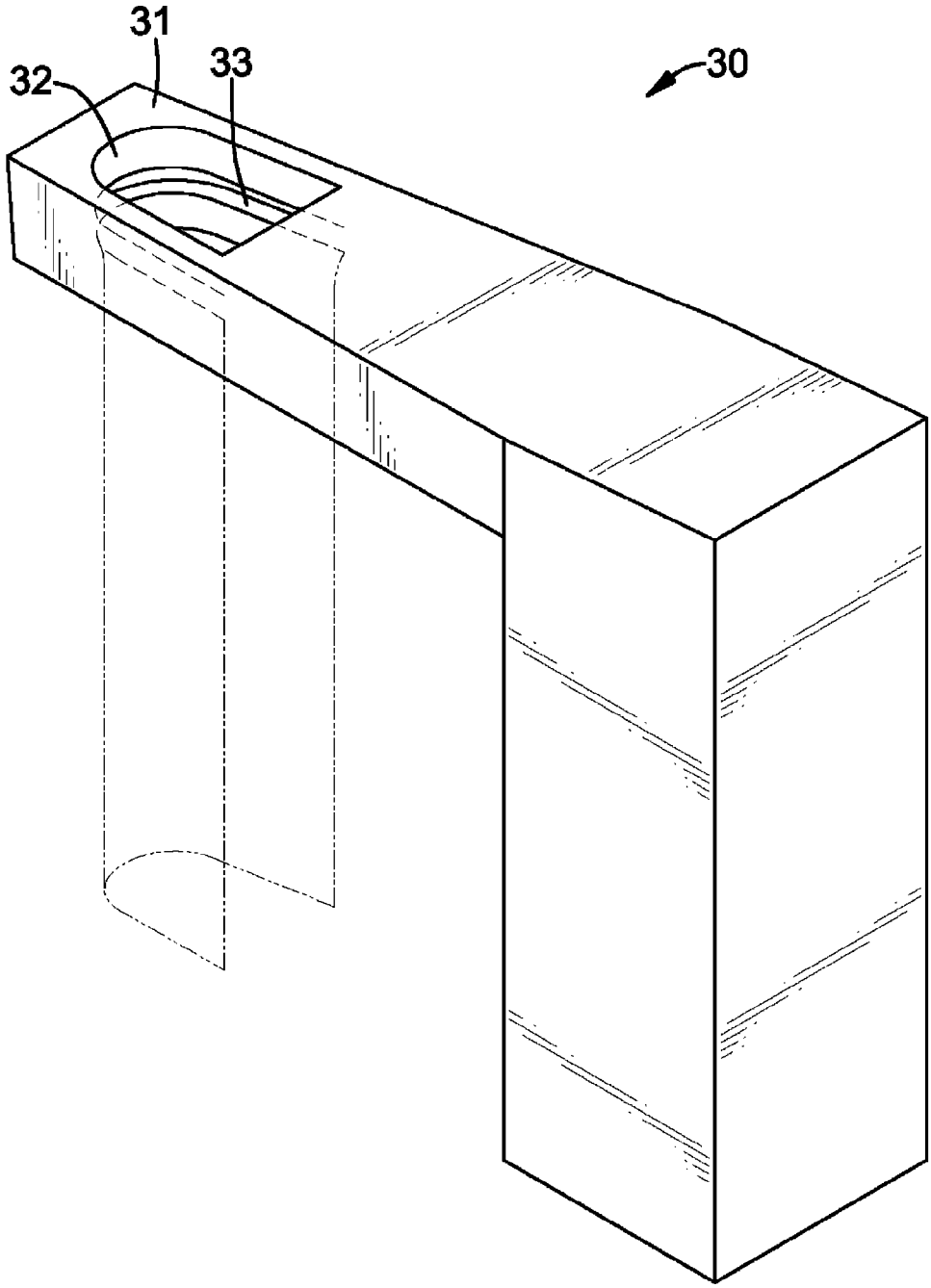
FIG. 5 is another perspective view of the outlet of a spigot in FIG. 4.

With reference to FIGS. 4 and 5, an outlet 30 of a spigot of a third embodiment in accordance with the present invention has a similar structure as an outlet 10 of a spigot in the first embodiment. The head 31 of the outlet 30 has a through hole 32. The through hole 32 is formed through the head 31 to form a U-shaped internal surface. The outlet hole 33 is formed through the internal surface of the head 31 to form a U-shaped water column.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An outlet of a spigot comprising a bottom seat having a bottom face;

a neck formed on and protruding upward from the bottom seat;

a head formed on and protruding forward from the neck and having a through hole formed through the head to form a U-shaped internal surface; and a flow passage formed in the outlet between the bottom seat, the neck and the head and having at least one inlet hole formed through the bottom face of the bottom seat and communicating with the flow passage; and an outlet hole being U-shaped, formed through the U-shaped internal surface of the head and communicating with the flow passage.

* * * * *